United States Patent [19]

Mouterde et al.

[11] 4,418,725

[45] Dec. 6, 1983

[54] HOOK FOR JACQUARD MACHINE

[76] Inventors: Pierre Mouterde, Le Cartallet - Eyzin Pinet, 38780 Pont Eveque; Ulrich Mutschler, 41A rue Pasteur, 69300 Caluire, both of France

[21] Appl. No.: 318,073

[22] Filed: Nov. 3, 1981

[30] Foreign Application Priority Data

Nov. 3, 1980 [FR] France ..... 80 23665

[51] Int. Cl.[3] ..... D03C 3/00

[52] U.S. Cl. ..... 139/59

[58] Field of Search ..... 139/59, 60, 61, 62, 139/63, 64, 65

[56] References Cited

U.S. PATENT DOCUMENTS

| | | | |
|---|---|---|---|
| 3,967,652 | 6/1976 | Seiler | 139/59 |
| 4,046,987 | 8/1977 | Bucher | 139/59 |
| 4,296,782 | 10/1981 | Kremer | 139/65 |

FOREIGN PATENT DOCUMENTS

| | | | |
|---|---|---|---|
| 626334 | 4/1963 | Belgium | 139/65 |
| 664728 | 4/1929 | France | 139/65 |
| 370365 | 4/1959 | Switzerland | 139/59 |

*Primary Examiner*—Henry Jaudon

*Attorney, Agent, or Firm*—Dowell & Dowell

[57] ABSTRACT

An improved hook for a double-lift open shed Jacquard machine, each hook having first and second oppositely facing catches and having a boss for contacting in the low position of the hook a finger of the machine to displace the hook so that one of the catches engages a gripper of one frame, the boss being so located that the hook when in low position in displaced when pressed transversely by a needle so that the other catch engages a gripper of the other frame.

7 Claims, 17 Drawing Figures

HOOK FOR JACQUARD MACHINE

The present invention relates to improvements in the hooks of a Jacquard machine adapted to control the formation of the shed of a weaving loom. It also concerns dobbies which, contrary to the actual Jacquards, do not control a plurality of independent heddles, but control heddle frames.

A considerable number of means exist for making hooks for Jacquard machines or dobbies with a view to improving the yield of the machines in question. It is a common expedient to use the bars of a fixed or mobile grid to act on the hooks with a view to subjecting them to bending intended to displace their conventional catches so that they escape or, on the contrary, are seized by the grippers of the lower or upper frames. In general, the action of the bars on the hooks occurs while the latter have a high speed of displacement, so that they are subjected to considerable frictions and/or violent shocks. In addition, it is often necessary to displace the upper gripper frame to allow the hooks to descend, the minimum lateral displacement required of this frame being a function of the load on the hook. As, in the majority of cases, the lateral displacement of the frames is effected at the moment when this load is considerable, the hooks undergo too high a strain.

It has also been suggested to make hooks which separate into two layers depending on whether they rise or descend, said hooks being applied against the grippers which take them along. To this end, the grippers are disposed, parallel to the needles by which the hooks are pressed. As, in this case, it is desired to be able to achieve effective intersection of the grippers, the space between the two grippers of a hook which belong to the two frames is relatively reduced whilst the displacement in the direction perpendicular to the needles due to the hooking of a gripper is small, therefore delicate. Such a device is described in French Pat. No. 76 22605. This arrangement does not make it possible to have a correct relative displacement between the catches of the hook and the grippers due to the clearance created by the slide of said catches on the corresponding grippers.

Single-arm hooks also exist which require the use of a Jacquard system with two cylinders, which is a major drawback due to the cost of such a system.

In other arrangements, hooks have been provided which necessitate the use of two mobile grids, this complicating manufacture of the systems using such hooks.

Upon a technical malfunction, weaving looms generally stop abruptly. Due to their inertia, certain hooks, being in ascending displacement at the time of stopping, disengage from the grippers. This phenomenon is prejudicial if the hook is under stress at that moment, since it does not fall back on the gripper but it returns directly to its rest position, i.e. in abutment on the bottom board. This occurrence risks deteriorating the hooks and creates weave errors when the loom resumes operation as the position of the hooks is then indefinite.

The improvements forming the subject matter of the present invention aim at remedying the drawbacks of the hooks and devices acting thereon which presently exist on the market and aim at enabling a Jacquard machine to be produced whose hooks undergo only very weak stresses during operation.

In low position, i.e. when they rest on the bottom board, the hooks are thus in simple abutment against a stop. They are bent only during lateral pressing, at a time when they are at zero speed. There is therefore no friction. When the hooks are taken by the grippers of the upper frame, i.e. when they rise, the contact with the stop is very short and is effected at low speed. There again, the frictions are much reduced.

Due to the arrangement according to the invention, the bending of the hooks which is necessary to obtain the return movement of the press needles takes place when the hook is on the bottom board. The press therefore does not depend, or depends only little, on the load on the hooks, which enables a uniform degree of press to be obtained.

As the grippers of the frames are disposed in the conventional direction, the space between the blades for each hook is much larger than when said grippers are oriented parallel to the needles, with the result that the hooks arranged according to the invention may undergo wear without this being prejudicial to the general functioning.

The accompanying drawings, given by way of example, will enable the invention to be more readily understood, as well as the features that it presents and the advantages that it may procure.

Figure 1:
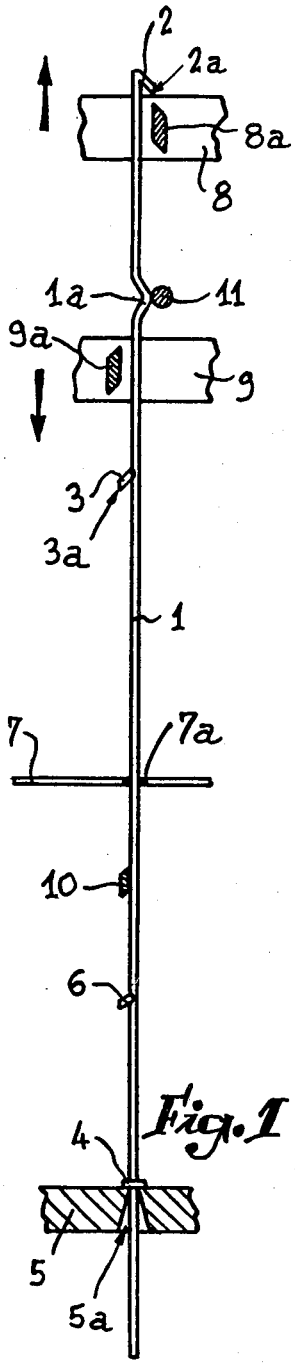
FIGS. 1 to 12 illustrate one of the hooks of a Jacquard machine where the improvements according to the invention are applied, in its different positions during the operation of the system.

FIG. 1 illustrates a hook 1 of a Jacquard machine or dobby, in the form of a rectilinear metal rod of which the upper end is provided with a first catch 2. A second catch 3 oriented opposite to the first is placed in the top part of the hook beneath the first, as is well known in the art. The lower part of the hook 1 is provided with a stop 4 adapted to rest on a conventional bottom board 5 which the hook traverses in a truncated perforation 5*a*. A third catch 6 is associated with the bottom of the hook 1. It will be noted that the three catches are rectilinear and oriented obliquely downwardly.

A needle 7 intersects the hook 1 to which it is connected by a loop 7*a* which said hook traverses.

The catches 2 and 3 of the hook are adapted to cooperate with grippers 8*a*, 9*a* respectively of an upper frame 8 and a lower frame 9.

The presence will also be noted of a lower blade 10, called an open shed blade, on which the catch 6 rests when it is desired that the hook remains in high position.

We shall go into no more detail concerning the above description, which corresponds to an arrangement well known in the art.

According to the invention, the hook 1 is provided with an offset boss 1*a* located in the plane of the catches 2 and 3 which, in low position of this hook, is in abutment against a stop made in the form of a fixed finger 11 which may, moreover, be constituted by one of the bars of a fixed grid. As illustrated in FIG. 1, the orientation of the hook 1 in low position, i. e. when its stop 4 is resting on the bottom board 5, is determined by the abutment of the boss 1*a* against the finger 11. In the position shown, the end 2*a* of the first catch 2 is slightly offset with respect to the upper gripper 8*a* so that, when the latter rises, it hooks the catch 2 firstly by its end then over the whole of its length due to the relative lateral displacement of said catch with respect to the upper inclined face of the gripper. It will be observed that the boss 1*a* virtually does not make the hook work under bending strain, its role being solely to orient it. When the boss 1*a* is not in contact with the finger 11, each hook 1 works in the same manner as the conventional single-arm hooks of the known Jacquard machines.

Figure 2:
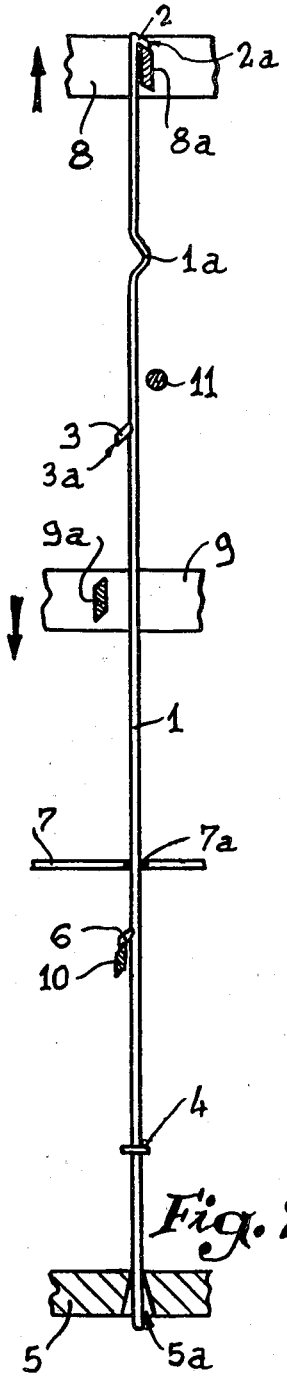
Figure 3:
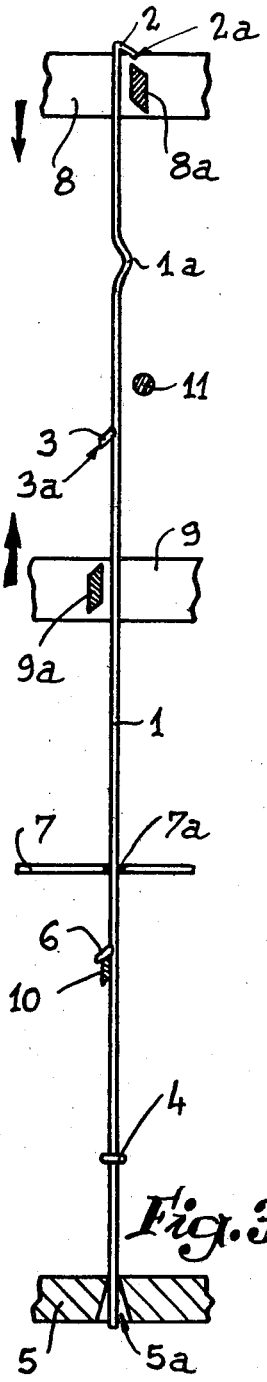
Figure 4:
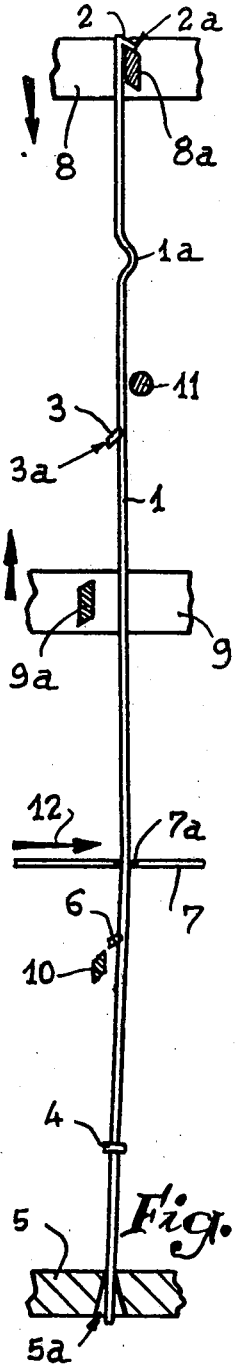

In FIG. 2, the first catch 2 of the hook 1 has been seized by the gripper 8*a* of the upper frame 8 so that, upon redescent of this frame 8, the third catch 6 is retained by the open shed blade 10, this corresponding to the open shed position (FIG. 3). If it is desired that the hook 1 descends, the needle 7 is displaced in the direction of arrow 12 (FIG. 4) when the frame 8 has effected its complete stroke, i.e. when it is located at top dead centre of said stroke. All that moment, the catch 6 is located slightly above the blade 10 so that displacement (called press in the art) of the needle 7 towards the right moves said catch away so that, when the frame 8 descends, it escapes the open shed blade 10.

Figure 5:
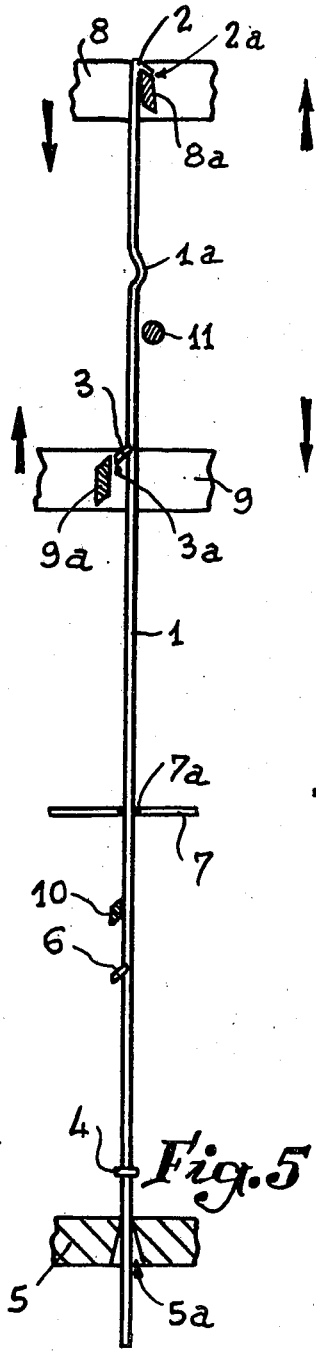

The position of FIG. 5 corresponds to the passage of the second catch 3 of the hook beside the gripper 9*a* of the lower frame 9 which rises whilst the hook descends. It is observed that, due to the lateral displacement of the first catch 2 towards the right as it descends with respect to the gripper 8*a*, the end of the catch 3 does not come into contact with the gripper 9*a* with the result that it may pass by the frame without problem.

Figure 6:
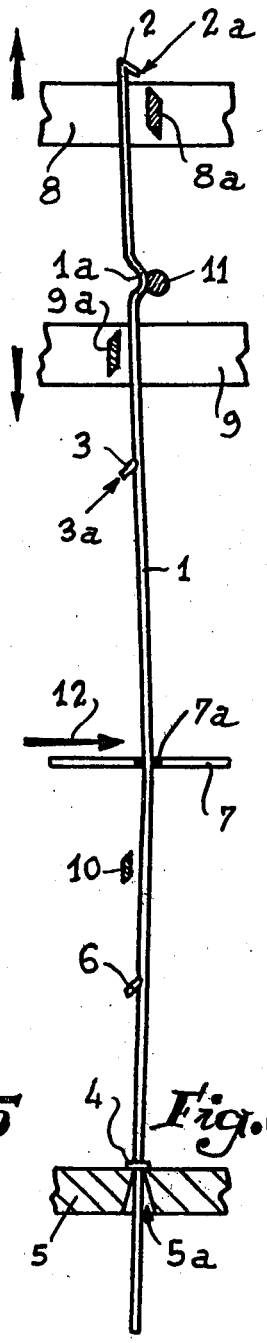

FIG. 6 illustrates the position of the hook 1 when it is not desired that it be engaged by the gripper 8*a* of the upper frame 8. To this end, the needle 7 is pressed (in the direction of arrow 12) so as to bend the hook which then rests on the one hand against the finger 11 and on the other hand against the lateral wall of the perforation 5*a*. This deformation causes the offset of the first catch 2 towards the left so that, when the gripper 8*a* rises, it does not hook on said catch.

Figure 7:
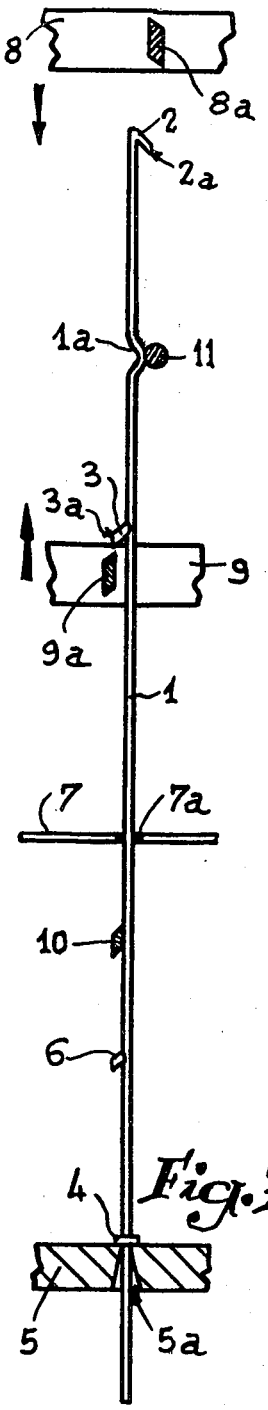

FIG. 7 is a view similar to that of FIG. 1, but showing the gripper frames 8 and 9 in their position most remote from each other, whilst in FIG. 1 they are shown in their position closest to each other.

Figure 8:
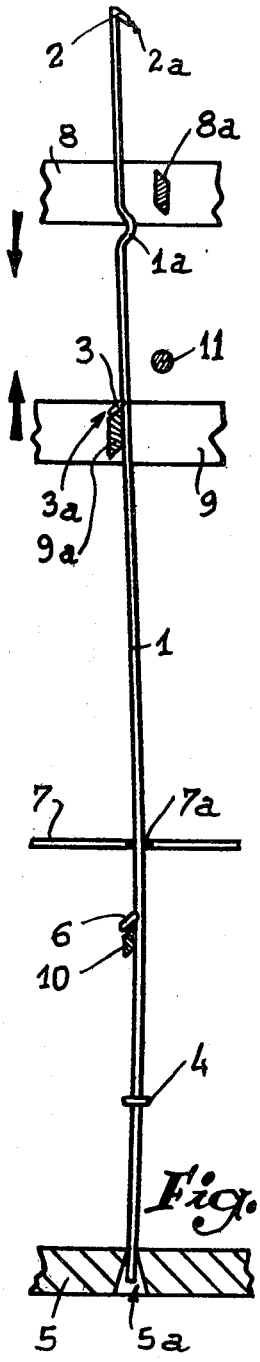

When the frames 8 and 9 occupy the position illustrated in FIG. 7, the hooks 1 may be raised by action of the grippers 9*a* of the frame 9 on the second catches 3. In fact, in FIGS. 1 and 7, the ends 2*a*, 3*a* of the catches 2 and 3 are slightly offset with respect to the corresponding faces of the grippers so that, if one or the other rises, it hooks respectively on the catch 2 (FIG. 1) or catch 3 (FIG. 7). As a result of the lateral displacement of the hook due to the cooperation of the inclined catch 3 with the upper oblique face of the gripper 9*a*, the first catch 2 avoids the gripper 8*a* when the frame 8 descends. FIG. 8 illustrates the hook in the course of rising, driven by the gripper 9*a* of the lower frame 9.

Figure 9:
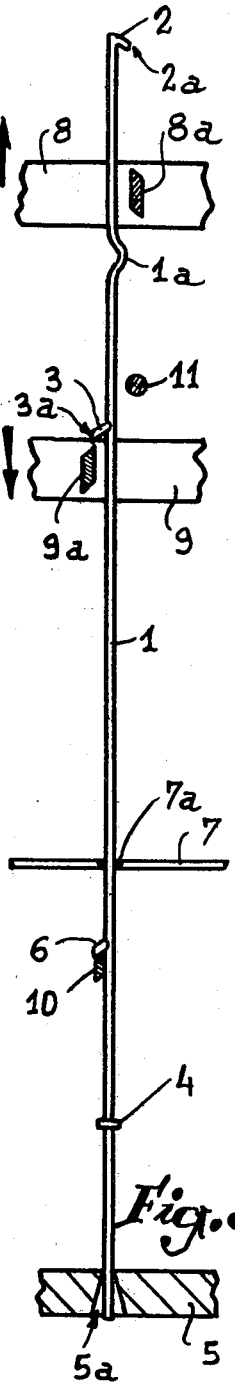

When the two frames move away from each other again, i.e. when the lower frame redescends, if no force is applied to the hook by pressing via the needle 7, this hook remains in high position by cooperation of its third catch 6 with the open shed blade (FIG. 9).

Figure 10:
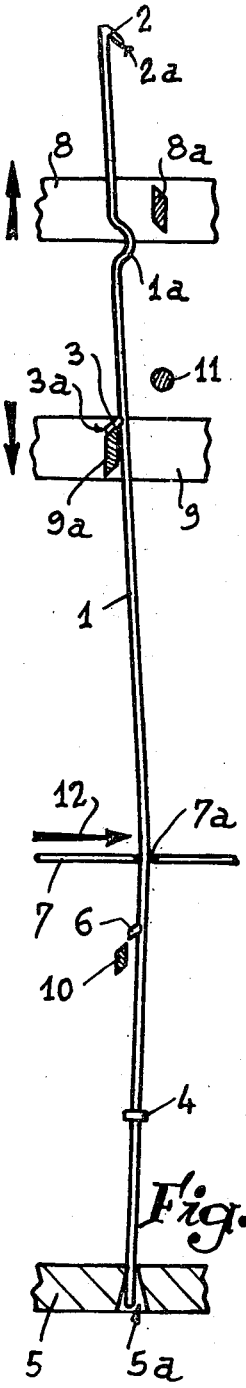

If a press in the direction of arrow 12 is exerted by the needle 7 in high position of the hook (FIG. 10), the catch 6 escapes the open shed blade 10 and it redescends to its low position of FIG. 7.

Figure 11:
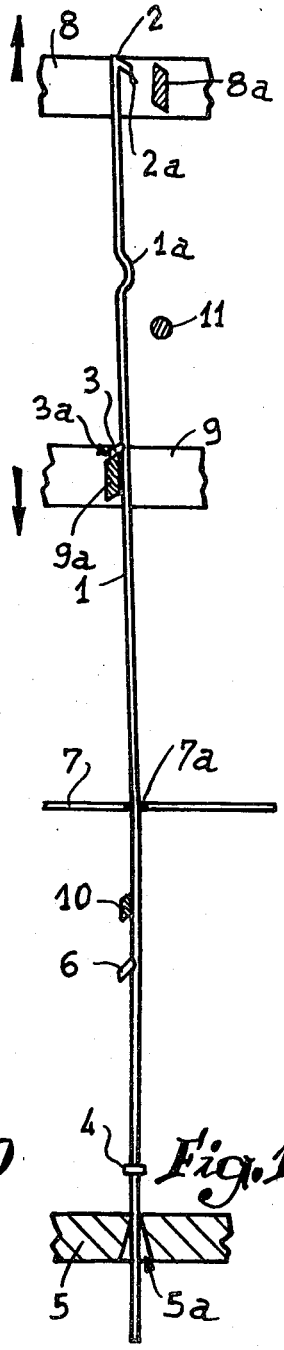

As with reference to FIG. 5 the position of the hook illustrated in FIG. 11 shows how the leftward displacement of the hook provoked by the cooperation of the second catch 3 with the grippers 9*a* causes an orientation of the hook such that its catch 2 may pass by the gripper 8*a* when the latter rises and the hook descends.

Figure 12:
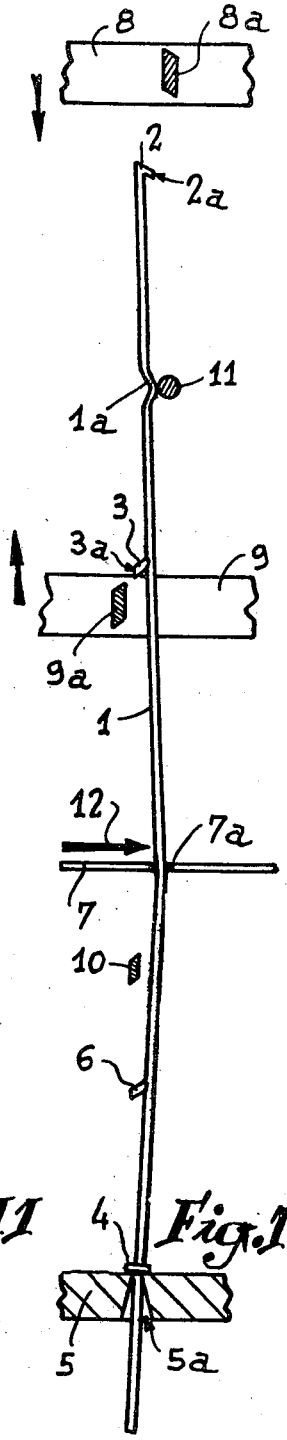

If the press is exerted in the direction of arrow 12 on the hook located as illusrated in FIG. 7, its bending between the finger 11 and the lateral face of the perforation 5*a* of the bottom board 5 causes offset of the catch 3 out of range of the gripper 9*a* so that, when the later rises, it cannot act on the hook which remains in its original position (FIG. 12).

Figure 13:
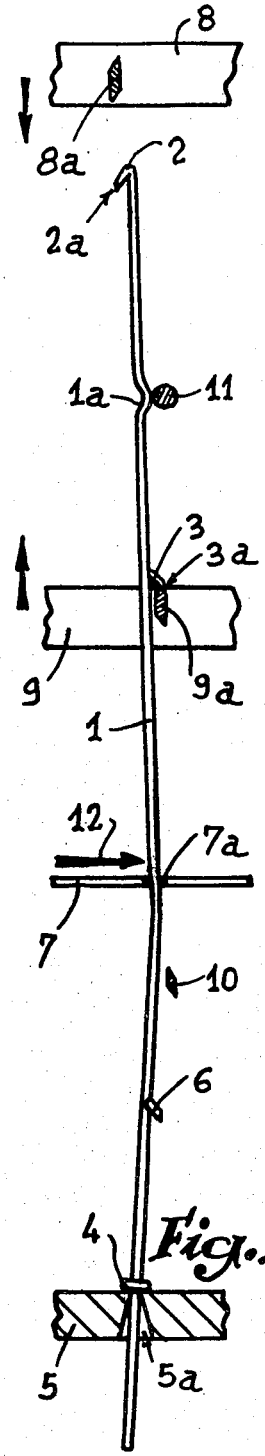
FIG. 13 is a view similar to that of FIG. 12, but illustrating a modified embodiment of the hook so that it may operate with a reversed press.

Of course, the hook according to the invention may very well be used during a reversed press as illustrated schematically in FIG. 13 in which the orientation of the catches of the hook has been reversed with a view to not changing the direction 12 of the press by the needles 7. It is observed that, under the influence of this rightward press, the catch 3 is placed above the gripper 9*a* of the lower frame 9, so that, when said frame is raised, the hook is raised. There again, the bending of the hook due to the press is provided between the finger 11 and the bore 5*a* of the bottom board 5; in this case, the slide of the catch on the blade is not indispensable, the press may place the catch directly above the gripper.

Figure 17:
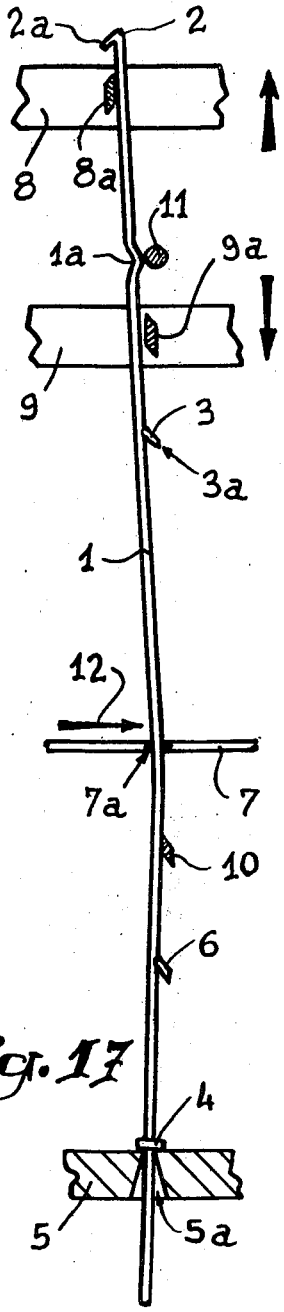
FIG. 17 is a view similar to that of FIG. 13, but illustrating the engagement of the upper catch of the hook by the corresponding blade of the upper frame in low position.

If the hook 1 is pressed when the two frames 8 and 9 are respectively in their lowest and highest positions (FIG. 17), the rise of the upper frame 8 causes the hooking of the upper catch 2*a* by the corresponding blade 8*a* of said frame. Thus, the hook rises from its rest position on the bottom board 5.

Figure 14:
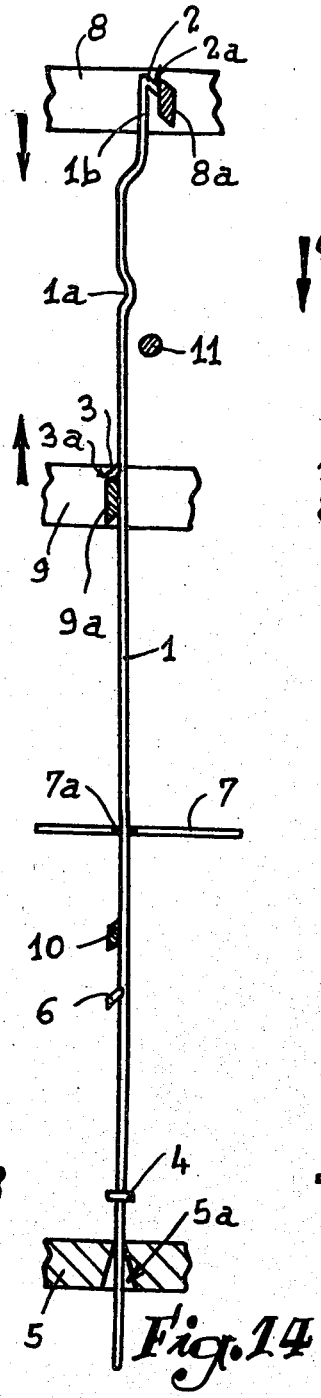
FIG. 14 is a view similar to that of FIG. 11, but showing a modified embodiment of the hook, its upper end being offset.

FIG. 14 illustrates a modified embodiment in which the upper end of the hook 1 is offset in the direction of the boss 1*a*. This upper end comprises a straight portion 1*b* parallel to the body of the hook 1. The grippers 8*a* are of course offset by the same distance in order that their operation remains as explained above. Under these conditions, when the catch 2 is gripped by the gripper 8*a*, this catch and a short length of the portion 1*b* are engaged with the corresponding edge of the gripper 8*a*. Upon subsequent upward displacement of the frame 8, there is therefore no risk of floating rotation of the hook due to the contact by the finger 11 on the boss 1*a*, which can occur in the embodiment of FIGS. 1 to 12. The presence of the offset part 1*b* of the hook causes leftward press by the finger to be applied at a concave location between the support points of the hook at the catch 2 and the board 5, and therefore ensures an excellent stability as soon as it is engaged by the grippers of the frames.

Figure 15:
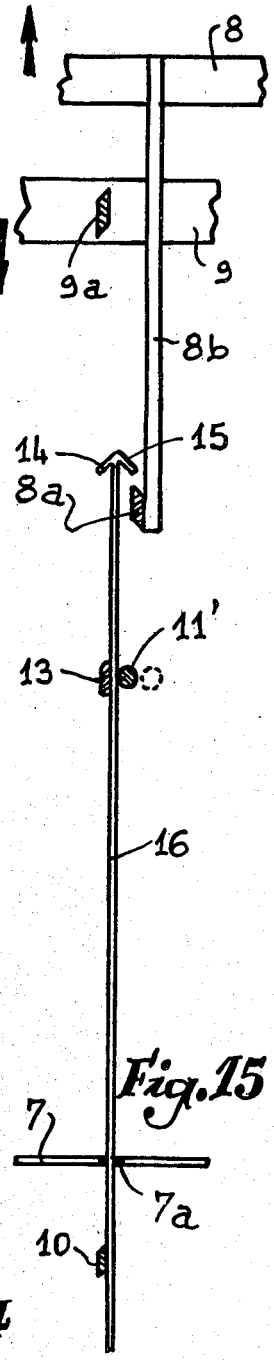
FIG. 15 illustrates another modification of a hook adapted to allow mutual crossing of the grippers.

It will be noted that the function achieved by the boss 1*a* of the hook 1 and the finger 11 may be obtained using a rectilinear hook on condition that the finger is displaceable laterally leftward as referenced 11' in FIG. 15. Under these conditions and to allow definite positioning on the hook, a fixed stop 13 is disposed opposite the mobile finger 11' so that the latter pushes the hook against the stop.

FIG. 15 illustrates frames 8 and 9 which have parts that cross each other so that the grippers 8*a* of frame 8 are mounted at the end of a rod 8*b* passing through the frame 9 between its grippers 9*a*. Under these conditions, a hook may be used wherein the catches 2 and 3 are replaced by other catches its end which are shown in the Figure under references 14 and 15, the hook itself being referenced 16. The functioning of such a hook remains, of course, perfectly identical to that of the member described with reference to the preceding Figures.

Figure 16:
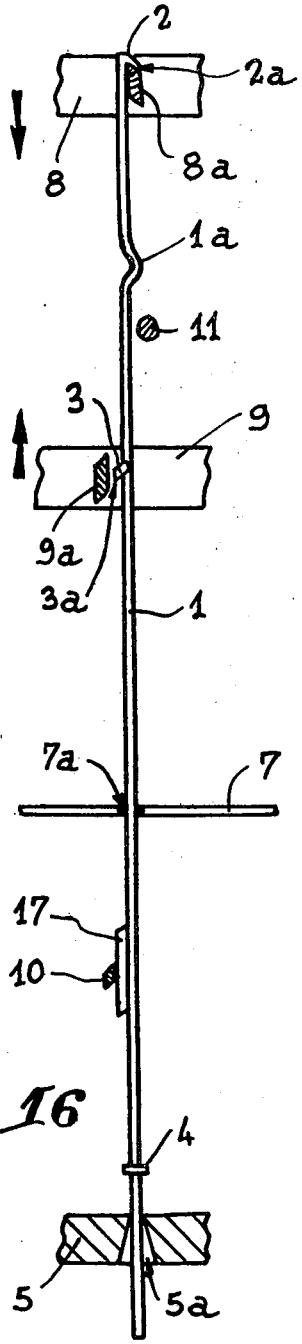
FIG. 16 shows another modification enabling functioning to be improved at the moment when the catches of the hooks engage the grippers of the frames.

In the embodiment illustrated in FIG. 16, the open shed catch 6 has been replaced by a small bar 17 of which the operation is improved at the moment of crossing of the catch 3 and the gripper 9*a* of the lower frame 9 when the hook 1 is engaged by an upper catch 2. This bar 17 in fact prevents the bending of the hook due to the press and facilitates intersection of the catch 3 and the gripper 9*a*. The length of the bar 17 is such that it is not in contact with the open shed blade 10 when the hook 1 rests against the bottom board 5 in order not to disturb the correct gripping of the hook by the grippers.

Moreover, it must be understood that the preceding description has been given only by way of example and that it in no way limits the domain of the invention, the replacement of the details of execution by substitution of equivalent not departing from its scope.

We claim:

1. An improved hook mechanism for a double-lift open shed Jacquard machine of the type having upper and lower frames reciprocated vertically in opposition to one-another and respectively having grippers for engaging catches on the hooks for raising the hooks to raised positions, the machine having Jacquard needles extending across the hooks and respectively operative to displace the hooks laterally to select engagements of the grippers with the catches to control the weaving pattern, the hooks normally resting in their low positions on a bottom board having perforations for receiving the lower ends of the hooks, the improvements wherein:

(a) each hook comprises a linear rod extending vertically through a needle and having a lower end extending through a perforation in the bottom board and having a stop operative to support the hook in said low position, the hook having a first catch near the top of the rod and having a second catch on the opposite side of the rod, and the hook having a laterally offset boss located below the first catch and extending away from the rod in the plane of the catches; and (b) the machine having finger means extending laterally across the hooks at the level of their bosses when the hooks are in low position, and the finger means engaging the boss of a hook in low position and orienting the hook such that, in cooperation with the press of an associated needle in one direction or in the opposite direction, one of the first or second catches of said hook will be offset with respect to a gripper of an associated one of the frames and not raised thereby and the other catch of the hook will be oriented to be engaged by an associated gripper of the other frame, the bosses being so located with respect to said finger means that engagement therebetween occurs only in said low position when the stops of the hooks are resting on the bottom board.

2. An improved hook mechanism as claimed in claim 1, wherein the second catch is located on the rod in a position below the first catch, and wherein each boss comprises an offset curve in the rod which is located between said first and second catches and extends toward a finger means when the hook is in low position.

3. An improved hook mechanism as claimed in claim 2, wherein each first catch is supported by an upper portion of a hook which is offset laterally by a bend in the rod above the associated boss, which bend displaces said upper portion and the first catch laterally in the same direction as the boss.

4. An improved hook mechanism as claimed in claim 1, wherein the finger means for engaging the hooks are moveable laterally relative to the hooks to selectively effect engagements of the catches with the associated grippers.

5. An improved hook mechanism as claimed in claim 4, wherein a fixed stop is supported by the machine adjacent to each laterally moveable finger means on the opposite side of the hooks therefrom.

6. An improved hook mechanism as claimed in claim 4, wherein the first and second catches on each hook are located at the top of the hook facing oppositely from eachother, and said frames have grippers which pass vertically adjacent to the respective hooks.

7. An improved hook mechanism as claimed in claim 1, wherein each hook has an open shed catch thereon, and the machine has blade means selectively operative to engage the open shed catches when the hooks are in raised position, each open shed catch on a hook comprising a linear bar extending parallel to the rod and fixed thereto.

* * * * *